United States Patent [19]

Horton

[11] 4,269,254

[45] May 26, 1981

[54] TROLLEY AND TRACK

[76] Inventor: Francis B. Horton, 7 Pinecrest Dr., Wellington, Kans. 67152

[21] Appl. No.: 17,117

[22] Filed: Mar. 5, 1979

[51] Int. Cl.[3] ..... E05D 15/26

[52] U.S. Cl. ..... 160/206; 160/118

[58] Field of Search ..... 160/118, 199, 206; 49/410, 411, 425, 112 G

[56] References Cited

U.S. PATENT DOCUMENTS

| | | | |
|---|---|---|---|
| 781,665 | 2/1905 | Kusch | 160/206 |
| 922,612 | 5/1909 | Mull | 49/410 |
| 1,060,132 | 4/1913 | Schaefer | 160/206 |
| 1,463,346 | 7/1923 | Walker | 160/118 |
| 2,804,136 | 8/1957 | Ternes et al. | 49/410 |
| 3,169,574 | 2/1965 | Behlen | 49/426 |
| 3,435,877 | 4/1969 | Horton | 160/206 |

*Primary Examiner*—Peter M. Caun

*Attorney, Agent, or Firm*—John H. Widdowson

[57] ABSTRACT

A method of aligning and subsequently fixing a horizontal track relative to a plurality of trolleys where the trolleys are movable along a straight line, and an improved bottom trolley and fixed structure.

4 Claims, 6 Drawing Figures

FIG. 1
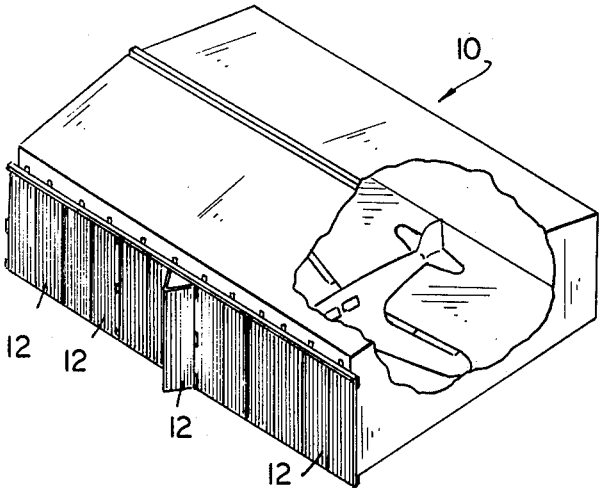
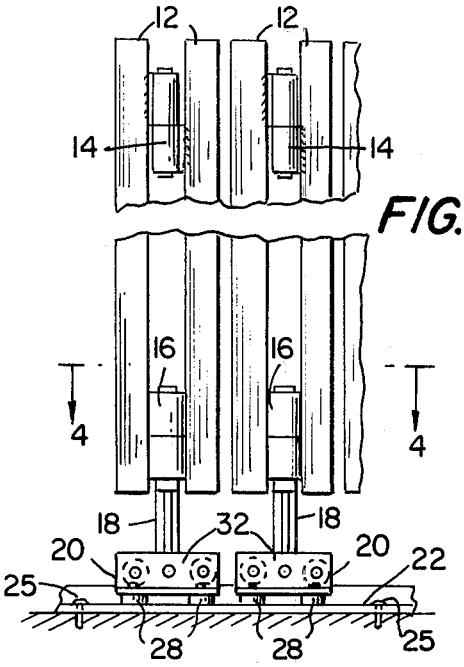
FIG. 3
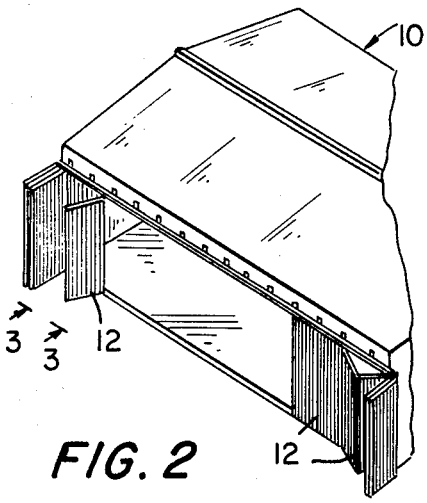
FIG. 2
FIG. 4
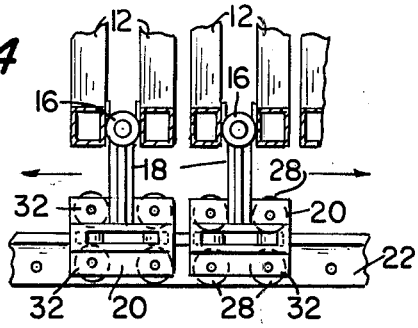
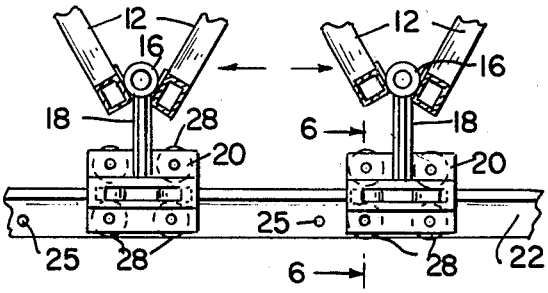
FIG. 5
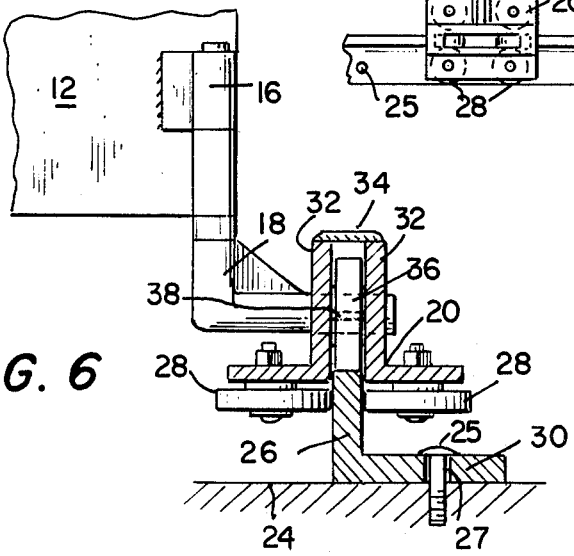
FIG. 6

TROLLEY AND TRACK

BACKGROUND OF THE INVENTION

1. Field of the Invention

This invention is related to a trolley and track structure. More specifically, this invention provides a trolley and track structure for folding and stacking doors, or hinged panels such as in hangars.

2. Description of the Prior Art

In my U.S. Pat. No. 3,435,877, issued Apr. 1, 1969 I invented a folding and stacking door means which included a trolley having a pair of rollers in rolling contact with a track structure. Since my invention, I have discovered an improved trolley which is more rigid and friction free than the trolley disclosed in my U.S. patent.

SUMMARY OF THE INVENTION

It is therefore an object of this invention to provide an improved trolley and track structure.

It is another object of this invention to provide a method of aligning and subsequently fixing a horizontal track relative to a plurality of trolleys where the trolleys are movable along a straight line.

Broadly, this invention includes an improved bottom trolley and fixed track structure comprising a plurality of trolleys, each trolley being individual to a pair of hinged panels; a track cooperating with all trolleys, said trolleys being operative to align the track automatically prior to fixing the track to a floor; and means for fixing the track to the floor after the automatic alignment. This invention also includes a method of aligning and subsequently fixing a horizontal track relative to a plurality of trolleys where the trolleys are movable along a straight linear path comprising the steps of placing the trolleys on the track while the track is movable; moving the trolleys along the movable track so that the track is free to register with the linear path of the trolley; and fixing the track to a rigid horizontal support whereby the trolley freely traverses the track with a minimum of friction.

The advantages and objects of the invention will become evident from the following detailed description when read in conjunction with the accompanying drawings which illustrate the preferred embodiments of the invention.

BRIEF DESCRIPTION OF THE DRAWINGS

FIG. 1 is a perspective view of a hangar with pairs of hinged panels which are supported by this invention;

FIG. 2 is a partial perspective view of the hangar having the pairs of hinged panels folded open;

FIG. 3 is a fragmentary front elevational view disclosing the invention supporting a pair of hinged panels;

FIG. 4 is a partial top plan sectional view taken along the plane of line 4—4 in FIG. 3;

FIG. 5 is a partial top plan view illustrating the movement of the invention as the hinged panels are closing; and FIG. 6 is an enlarged vertical sectional view taken along the plane of line 6—6 in FIG. 5.

DETAILED DESCRIPTION OF THE INVENTION

Referring in detail now to the drawings, wherein similar parts are identified by like reference numerals, there is seen a hangar, generally illustrated as 10, having a plurality of pair of hinged doors on panels 12 with an airplane 14 enclosed therein. Each pair of panels 12 comprises an upper hinged connection 14 and a lower hinged connection 16 with an L-shaped bar member 18 connecting to a bottom trolley 20 and fixed track structure 22. The track 22 cooperates with all trolleys 20 which are operative to align the track 22 automatically prior to fixing the track 22 to a floor 24. After the track 22 is automatically aligned, the track 22 is fixed to the floor 24 by some means, such as by bolts 25, concreted in, or any other means well known to those skilled in the art.

The track 22 is formed with a vertical web 26 and a plurality of guide means 28, preferably rollers which straddle the vertical web 26. The track 22 also is formed with a horizontal web 30 (see FIG. 6) which has a structure defining a plurality of apertures 27 for receiving bolts 25.

Trolley 20 comprises a pair of L-shaped members 32 to define a pair of spaced vertical webs and a pair of horizontal webs. A bridge member 34 joins the vertical webs of the L-shaped member. A plurality of bearing roller members 36 rotate on shafts 38 and are in rolling contact with the vertical web 26 of the track 22 and operate to support hinged pairs of panels 12.

With continuing reference to the drawings for operation of the invention in aligning and subsequently fixing the track 22 relative to the plurality of trolleys 20, the trolleys 20 are placed on the track 22 while the track 22 is movable and not fastened to the floor 24. Subsequently, the trolleys 20 are moved along the movable track 22 so that the track is free to register with the linear path of the trolley 20, and thereafter, the track 22 is fixed to the floor 24 by bolts 25 whereby the trolleys 20 are free to traverse the track 22 on bearing rollers 36 while being guided by rollers 28.

Changes may be made in the construction and arrangement of the parts or elements of the embodiments as disclosed herein without departing from the spirit or scope of the invention as defined in the following claims.

I claim:

1. In a closure device of the type comprising a plurality of pairs of hinged panels operative to fold and stack when moved relative to a floor or the like from a closed position to an opened position, an improved bottom trolley and fixed track structure comprising:

(a) a plurality of trolleys, each trolley being individual to a pair of hinged panels;

(b) a track cooperating with all trolleys, said trolleys being operative to align said track automatically prior to fixing said track to said floor; and (c) means for fixing the track to the floor after said automatic alignment;

said tracks being formed with a vertical web and the trolley includes a plurality of guide means operative to straddle said vertical web; said trolley being formed with a plurality of bearing roller members in rolling contact with the vertical web operative to support hinged pairs of panels; said trolley comprising a pair of L-shaped members defining a pair of spaced vertical webs and a pair of horizontal webs, said vertical webs being joined by a bridge member.

2. The device of claim 1 wherein the track is formed with a horizontal web having a structure defining a plurality of apertures.

3. The device of claim 1 in which the vertical webs are formed with mating apertures operative to receive and support the bearing members.

4. The device of claim 3 wherein the guide means comprise a plurality of rollers.

* * * * *